US007823517B2

(12) United States Patent
Roleder

(10) Patent No.: US 7,823,517 B2
(45) Date of Patent: Nov. 2, 2010

(54) MASSAGE TABLE WITH CURVED FRAME

(75) Inventor: Jon W. Roleder, San Diego, CA (US)

(73) Assignee: Earthlite Massage Tables, Inc., Vista, CA (US)

( * ) Notice: Subject to any disclaimer, the term of this patent is extended or adjusted under 35 U.S.C. 154(b) by 205 days.

(21) Appl. No.: 11/804,670

(22) Filed: May 18, 2007

(65) Prior Publication Data

US 2007/0266907 A1 Nov. 22, 2007

Related U.S. Application Data

(60) Provisional application No. 60/801,583, filed on May 18, 2006.

(51) Int. Cl.
*A47B 17/00* (2006.01)

(52) U.S. Cl. ..... 108/27; 108/35; 108/38

(58) Field of Classification Search ..... 108/35, 108/36, 38, 165, 27, 180, 158.12, 153.1; 248/188, 188.1
See application file for complete search history.

(56) References Cited

U.S. PATENT DOCUMENTS

| | | | | | |
|---|---|---|---|---|---|
| 1,206,582 | A | * | 11/1916 | Orofino | 108/36 |
| 2,934,386 | A | * | 4/1960 | Shore | 108/35 |
| 3,267,881 | A | * | 8/1966 | Saggione | 108/59 |
| 3,912,210 | A | * | 10/1975 | von Bohr | 248/188.1 |
| 3,980,026 | A | * | 9/1976 | Thomas | 248/188.1 |
| 4,128,284 | A | * | 12/1978 | King | 312/348.2 |
| D295,349 | S | | 4/1988 | Mueller | |
| 4,943,041 | A | | 7/1990 | Romein | |
| 5,009,170 | A | | 4/1991 | Spehar | |

(Continued)

OTHER PUBLICATIONS http://www.ovaltable.com/massageTables.html. These webpages include pictures of a prior art massage table sold by Creative Touch, 2003.

(Continued)

*Primary Examiner*—José V Chen
(74) *Attorney, Agent, or Firm*—Roeder & Broder LLP

(57) ABSTRACT

A massage table for supporting a person during a massage above a surface includes a leg assembly that engages the floor, and a first table top that includes a frame that is supported above the surface with the leg assembly. The frame includes a frame base that supports at least a portion of the person, and a border flange that is secured to the frame base and that extends downward from the frame base. The border flange can include a first side section, a first transverse section that extends transversely to the first side section, and a first connector section that connects the first side section to the first transverse section. The first connector section can be curved. Additionally, the border flange can include a second transverse section that extends substantially parallel to the first transverse section and a curved second connector section that connects the first side section to the second transverse section. A first segment of the first transverse section, a first part of the second transverse section, the entire first side section, the first connector section, and the second connector section are made of a continuous piece of material. For example, the continuous, piece of material can be a continuous piece of plywood that is bent during formation to form the first connector section and the second connector section.

19 Claims, 14 Drawing Sheets

U.S. PATENT DOCUMENTS

| | | | | |
|---|---|---|---|---|
| 5,524,555 | A | 6/1996 | Fanuzzi | |
| 5,678,491 | A * | 10/1997 | Price et al. | 108/115 |
| D403,772 | S | 1/1999 | Fanuzzi | |
| 6,076,472 | A * | 6/2000 | Lloyd | 108/36 |
| 6,123,031 | A * | 9/2000 | Hayman-Chaffey | 108/27 |
| 6,431,086 | B1 * | 8/2002 | Lloyd | 108/36 |
| 6,655,301 | B2 * | 12/2003 | Stanford | 108/132 |
| 6,684,426 | B1 | 2/2004 | Lin et al. | |
| 6,705,234 | B1 | 3/2004 | Miller et al. | |
| 6,883,882 | B2 * | 4/2005 | Lin | 108/180 |
| D533,667 | S | 12/2006 | Roleder | |
| 2005/0199159 | A1 * | 9/2005 | Searer | 108/94 |

OTHER PUBLICATIONS http://ww.oakworks.net/portables/advanta.html. These webpages include a picture of a prior art massage table sold by Oakworks, Inc., 2005.

http://www.customcraftworks.com/port_tables2.html. These webpages include pictures of a massage table sold by Custom Craftworks. The applicant believes this massage table was first sold in Apr. 2005.

* cited by examiner

MASSAGE TABLE WITH CURVED FRAME

RELATED APPLICATION

This application claims priority on pending Provisional Application Ser. No. 60/801,583 filed on May 18, 2006 and entitled "Massage Table With Curved Frame". As far as is permitted, the contents of Provisional Application Ser. No. 60/801,583 are incorporated herein by reference.

BACKGROUND

As the benefits of therapeutic massage are becoming more widely appreciated, more and more people are participating in therapeutic massage. A typical massage table allows the patient to be resting while receiving a massage. Important features for massage tables include high strength, light weight, and easy to fold.

SUMMARY

A massage table for supporting a person during a massage above a surface includes a leg assembly that engages the floor, and a first table top that includes a frame that is supported above the surface with the leg assembly. The frame can include a frame base that supports at least a portion of the person, and a border flange that is secured to the frame base and that extends downward from the frame base. The border flange can include a first side section, a first transverse section that extends transversely to the first side section, and a first connector section that connects the first side section to the first transverse section. In one embodiment, the first connector section is curved. In certain embodiments, with this design, the first table top is relatively easy to manufacture and provides improved strength.

Additionally, the border flange can include a second transverse section that extends substantially parallel to the first transverse section and a curved second connector section that connects the first side section to the second transverse section.

In one embodiment, a first segment of the first transverse section, a first part of the second transverse section, the entire first side section, the first connector section, and the second connector section are made of a continuous, jointless piece of material. For example, the continuous, piece of material can be a continuous piece of plywood that is bent during formation to form the first connector section and the second connector section. The continuous piece of material eliminates the need for joints near the corners of the massage table. As a result thereof, the border flange is very strong.

Moreover, the border flange can include a second side section that is spaced apart from the first side section, a curved third connector section that connects the second side section to the first transverse section, and a curved fourth connector section that connects the second side section to the second transverse section. In this embodiment, a second segment of the first transverse section, a second part of the second transverse section, the entire second side section, the third connector section, and the fourth connector section are made of a continuous piece of material. For example, the continuous, piece of material can be a continuous piece of plywood that is bent during formation to form the third connector section and the fourth connector section.

In one embodiment, the border flange also includes a first attacher that attaches the first segment of the first transverse section to the second segment of the first transverse section, and a second attacher that attaches the first part of the second transverse section to the second part of the second transverse section. For example, the first attacher can include a pin that extends between the segments of the first transverse section and a brace that extends over a segment junction between the segments.

Moreover, in one embodiment, a segment junction of the segments of the first transverse section and a part junction of the parts of the second transverse section are located near a center axis of the massage table. With this design, the joints of the border flange are located near the center axis and away from any high stress areas of the massage table.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
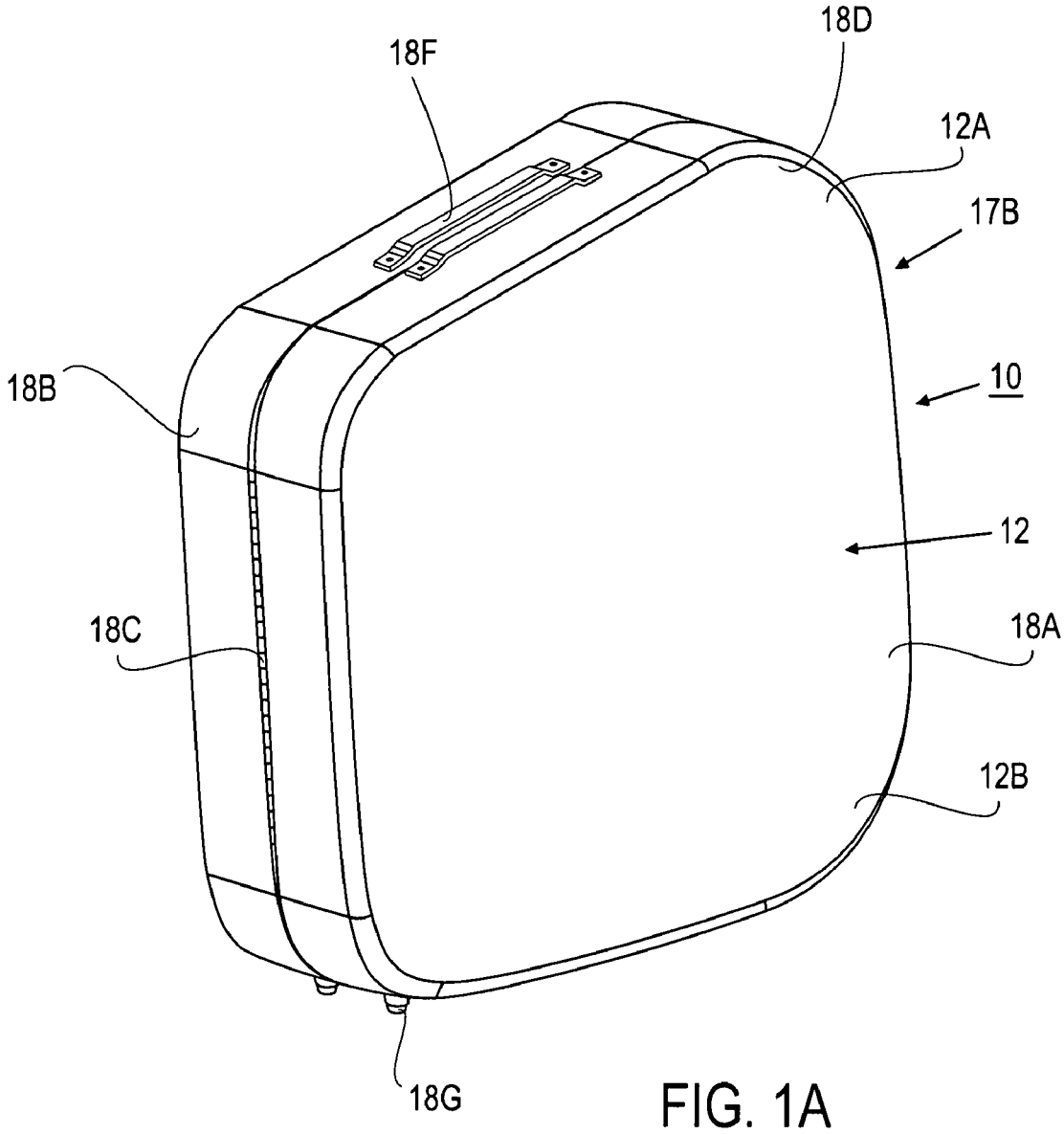
FIGS. 1A and 1B are alternative perspective views of a massage table in a transport configuration having features of the present invention.
Figure 1B:
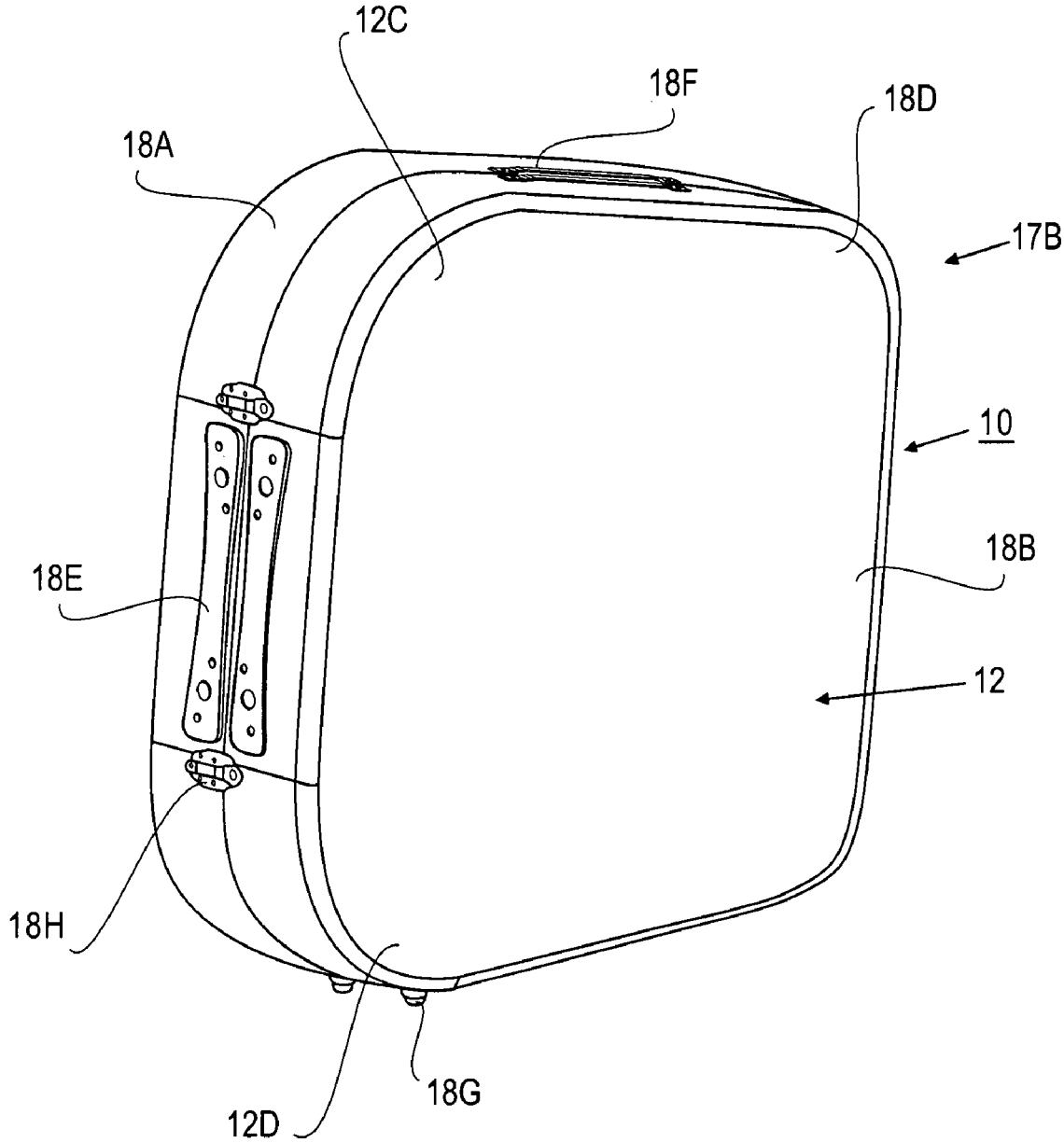
Figure 1C:
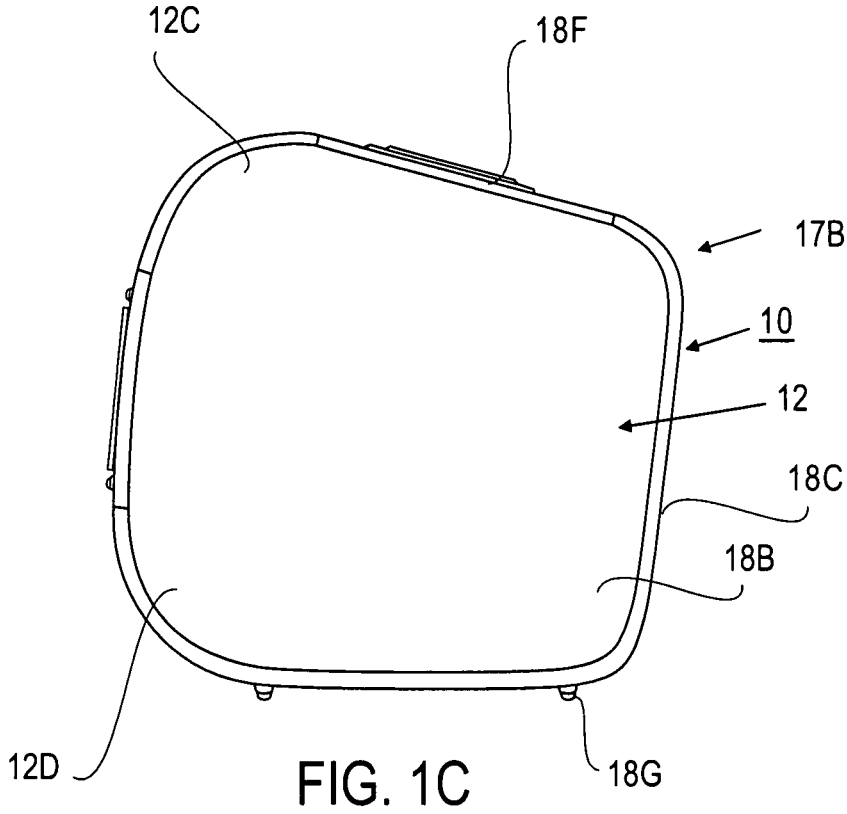
FIGS. 1C and 1D are alternative side views of the massage table in the transport configuration.
Figure 1D:
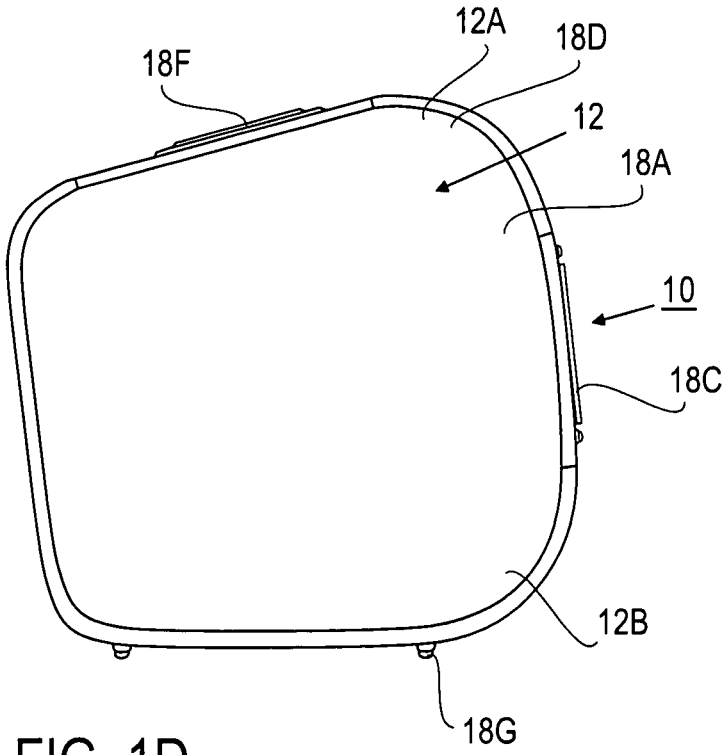
Figure 1E:
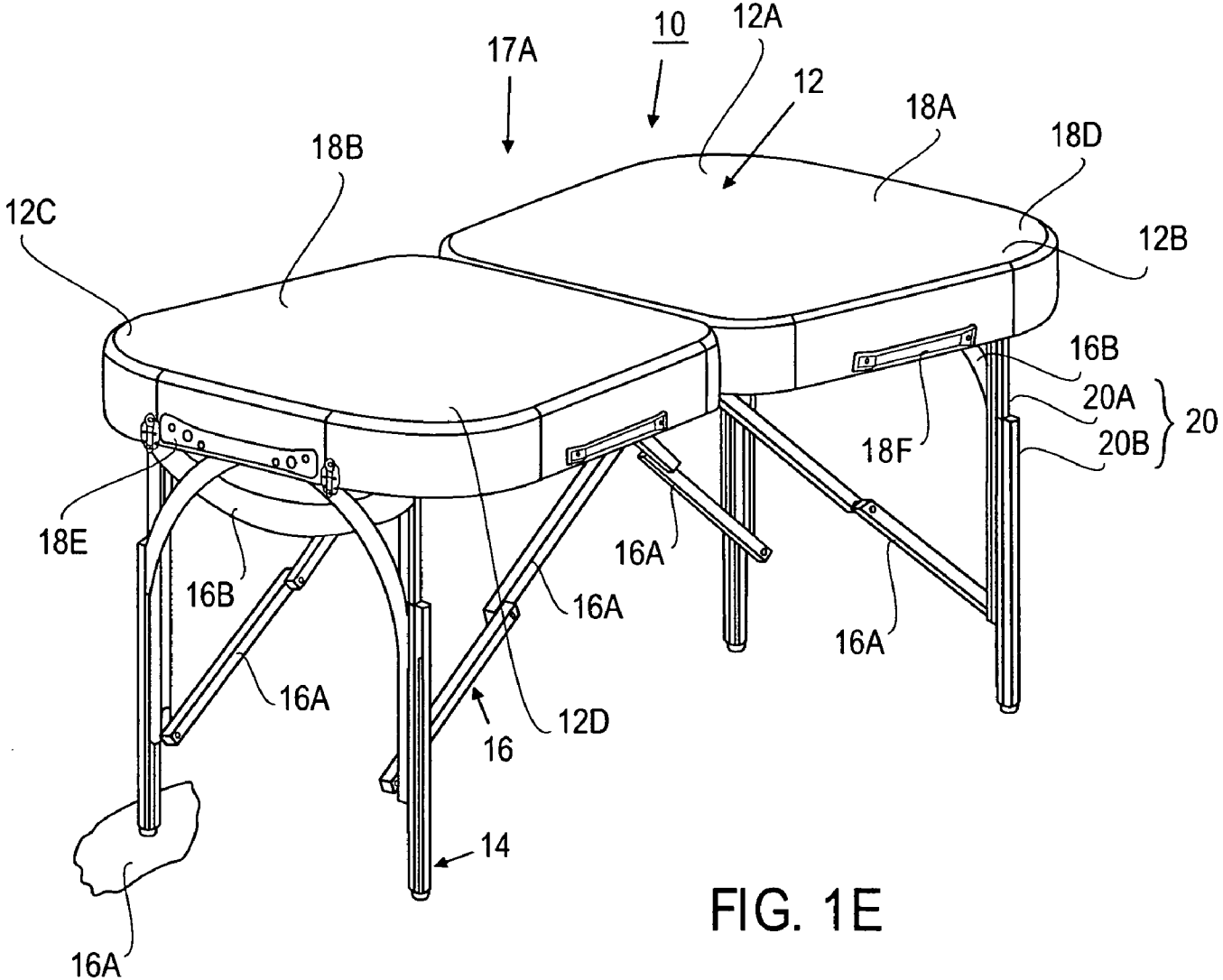
FIGS. 1E and 1F are alternative perspective views of the massage table in a working configuration.
Figure 1F:
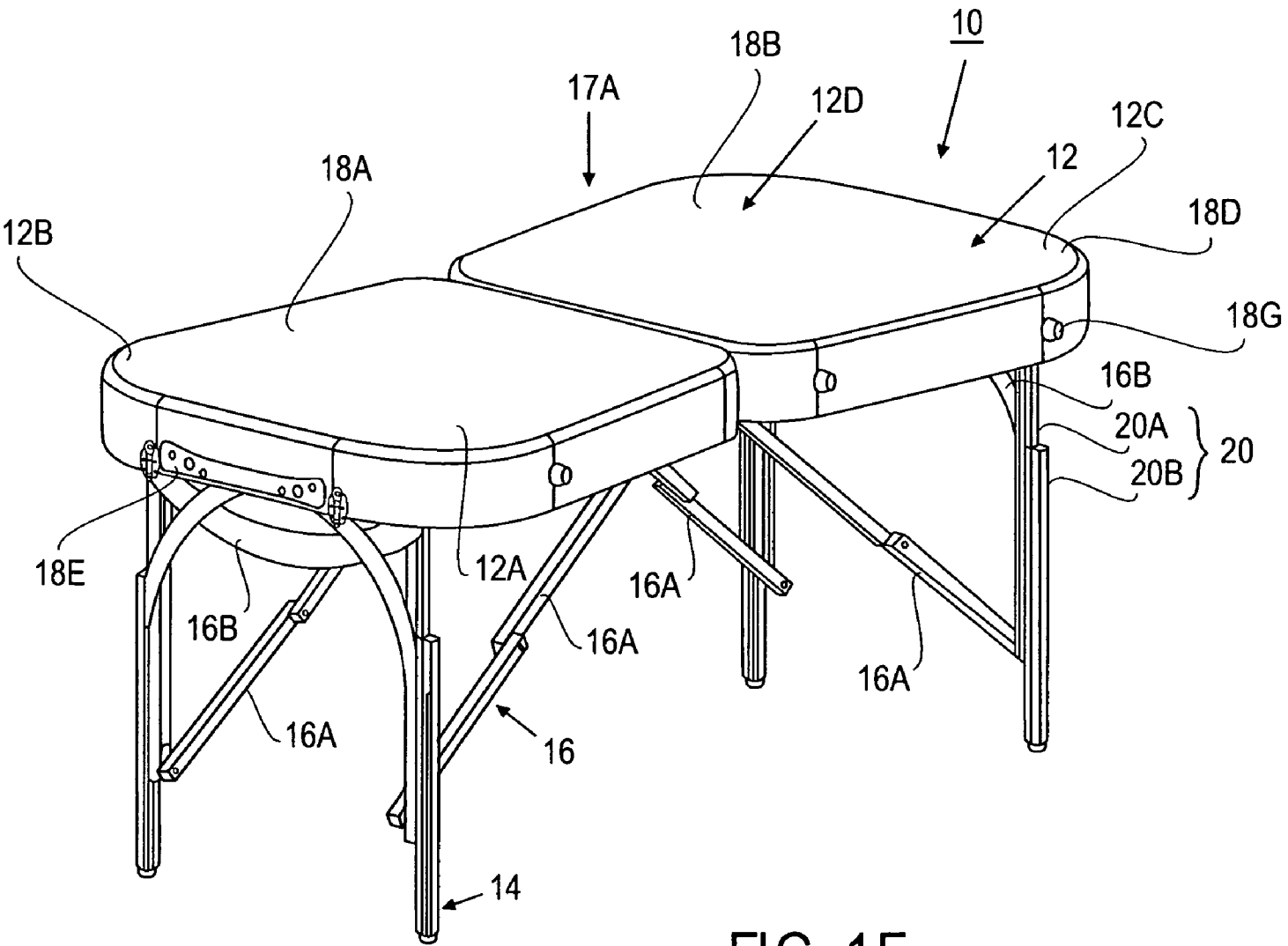
Figure 1G:
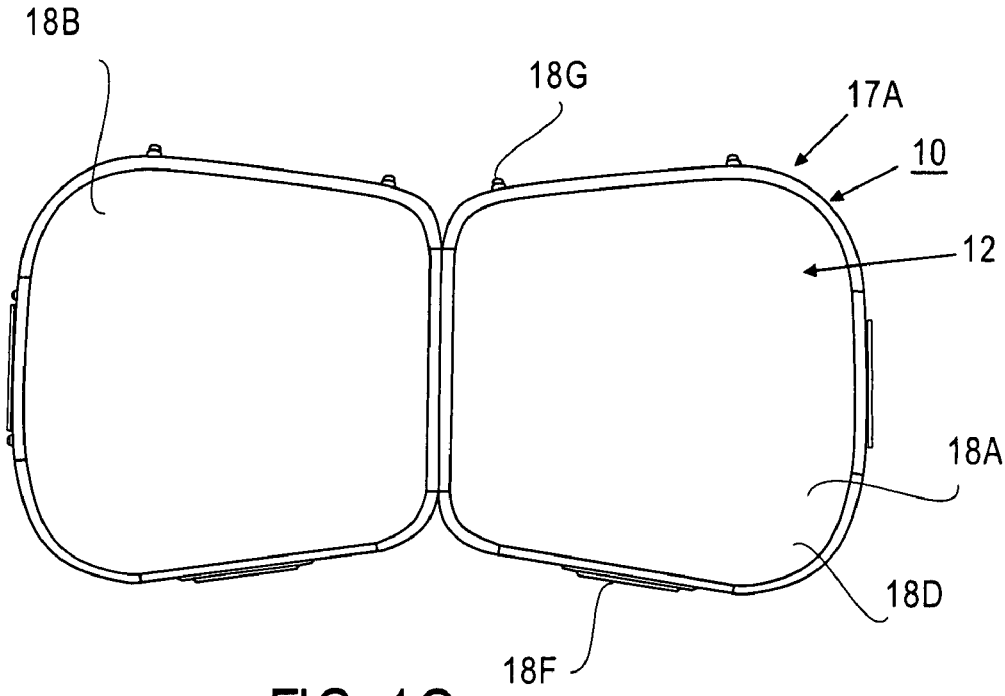
FIG. 1G is a top view of the massage table in the working configuration.
Figure 1H:
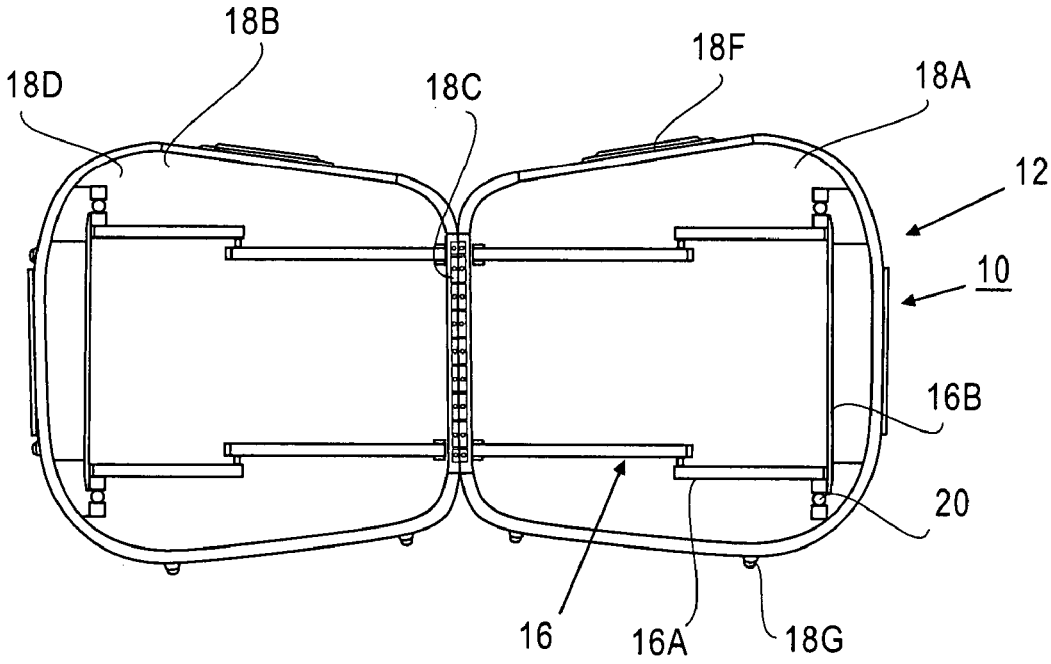
FIG. 1H is a bottom view of the massage table in the working configuration.

FIGS. 1-1H are alternative views of one embodiment of a massage table 10 having features of the present invention. In this embodiment, the massage table 10 includes a table top assembly 12, a leg assembly 14, and long and short braces 16. In certain embodiments, the massage table 10 is a portable, folding massage table that is moveable between a working configuration 17A (illustrated in FIGS. 1E-1H) and a transport configuration 17B (illustrated in FIGS. 1A-1D). In the working configuration 17A, the massage table 10 can be set up on a surface 19 (only partly illustrated in FIG. 1E) such as a floor or ground, and the massage table 10 is ready for usage. In the transport configuration 17B, the massage table 10 can be easily moved and stored.

As an overview, in certain embodiments, the table top assembly 12 includes a first table top 18A and a second table top 18B that are uniquely designed to have continuous, curved corners that provide improved strength characteristics. As a result thereof, the massage table 10 disclosed herein has very good strength to weight characteristics. Further, designs provided herein are relatively easy to manufacture and have a unique table top 18A, 18B profile.

The leg assembly 14 supports the table top assembly 12 above the surface 19. In one embodiment, the leg assembly 14 includes four spaced apart legs 20 that are pivotable and moveable connected to the table top assembly 12. In the Figures, the legs 20 are positioned near the four corners 12A-12D of the table top assembly 12. Alternatively, the leg assembly 14 could be designed with more than four or less than four legs 20 and/or the legs 20 can be positioned in another location than the four corners of the massage table 10.

It should be noted that the term "corner of the table top assembly 12" as used herein means the area in which the generally straight sides of the massage table are jointed to the generally straight front or rear of the table top assembly 12. Because the corners 12A-12D of the table top assembly 12 are curved, the sides and the front or rear of the table top assembly 12 do not meet and form an angle.

Additionally, each of the legs 20 can include an upper leg section 20A that is secured to the table top assembly 12, and a lower leg section 20B that is selectively moveable relative to the upper leg section 20A to selectively adjust the height of the table top assembly 12.

The brace assembly 16 provides additional support to the leg assembly 14 when the massage table 10 is in the working configuration 17A and facilitates folding and unfolding of the legs 20. In one embodiment, the brace assembly 16 includes a four angled braces 16A and a pair of leg braces 16B. In this design, each of the angled braces 16A extends between the table top assembly 12 and one of the legs 20 and each of the leg braces 16B extends between two of the legs 20.

It should be noted that one or more cables (not shown) can be used to additionally support the leg assembly 14. One embodiment of the leg assembly 14, the brace assembly 16, and cable structure is disclosed U.S. Pat. No. 5,009,170, issued to Spehar, the contents of which are incorporated herein by reference.

The table top assembly 12 provides a resting surface for a person to rest on during a massage. In one embodiment, the table top assembly 12 includes the first table top 18A, the adjacent second table top 18B, and a hinge assembly 18C. Additionally, the table top assembly 12 can include a headrest (not shown) that extends away from the front of the first table top 18A.

In the embodiment illustrated in FIGS. 1A-1H, each table top 18A, 18B is somewhat trapezoidal shaped with rounded corners 18D. Alternatively, for example, each table top 18A, 18B can be another shape, such as generally oval or rectangular shaped with rounded corners 18D.

Further, in one embodiment, the second table top 18B is approximately a mirror image of the first table top 18A. Alternatively, for example, each table top 18A, 18B can be different in design.

FIGS. 1A-1H illustrate that one or both of the table tops 18A, 18B can include (i) a rigid nameplate 18E (e.g. a piece of wood) that displays the name of the massage table 10 and that provides support for the headrest (not shown), (ii) a handle 18F that is used for carrying the massage table 10 in the transport configuration 17B and for moving the massage table 10 between the configurations 17A, 17B, (iii) one or more bumpers 18G that support the massage table 10 above the surface 19 when the massage table 10 is in the transport configuration 17B, and/or (iv) one or more latches 18H that can be used to selectively lock the massage table 10 in the transport configuration 17B. Other features of the table tops are described in more detail below.

The hinge assembly 18C connects the table tops 18A, 18B together and allows the table tops 18A, 18B to pivot relative to each other between (i) the working configuration 17A in which the table tops 18A, 18B are substantially in the same plane, and (ii) the transport configuration 17B in which the table tops 18A, 18B are in substantially parallel planes and adjacent to each other. In one embodiment, the hinge assembly 18C is a piano hinge that is attached to the each of the table tops 18A, 18B. Alternatively, the hinge assembly 24 can have another design.

Figure 2A:
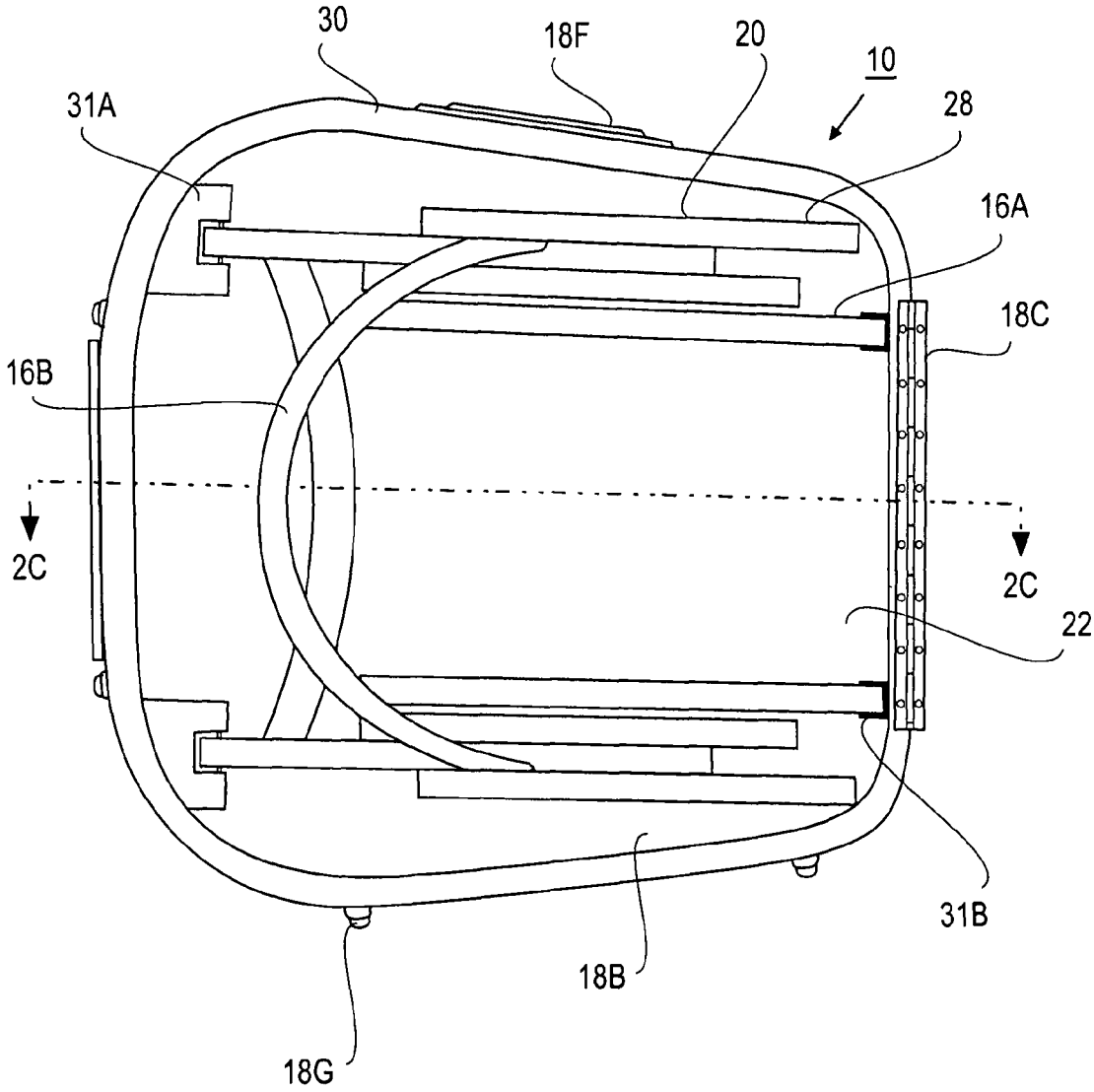
FIG. 2A is a bottom view and FIG. 2B is an end view of one half of the massage table with legs folded.

FIG. 2A is a bottom view and 2B is an end view of one half of the massage table 10 including the second table top 18B, the hinge assembly 18C, the legs 20 that are pivotable attached to the second table top 18B, two each of the straight braces 16A, one leg brace 16B, one handle 18F, one nameplate 18E, a couple of bumpers 18G, and a portion of two latches 18H. In FIG. 2A, the legs 20 are illustrated in a folded configuration.

Figure 2B:
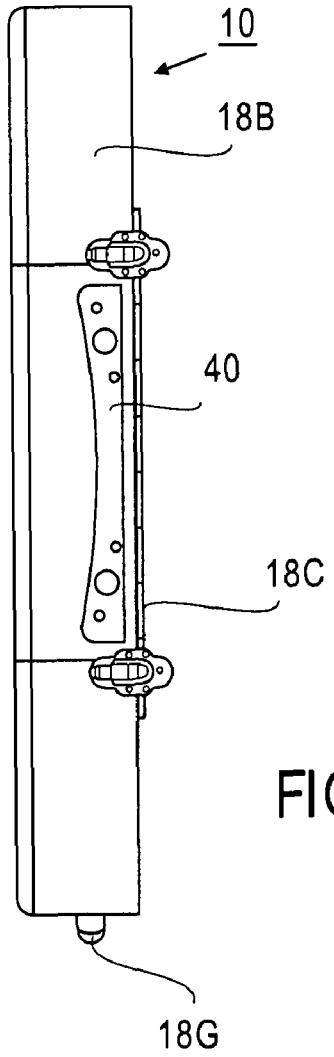
Figure 2C:
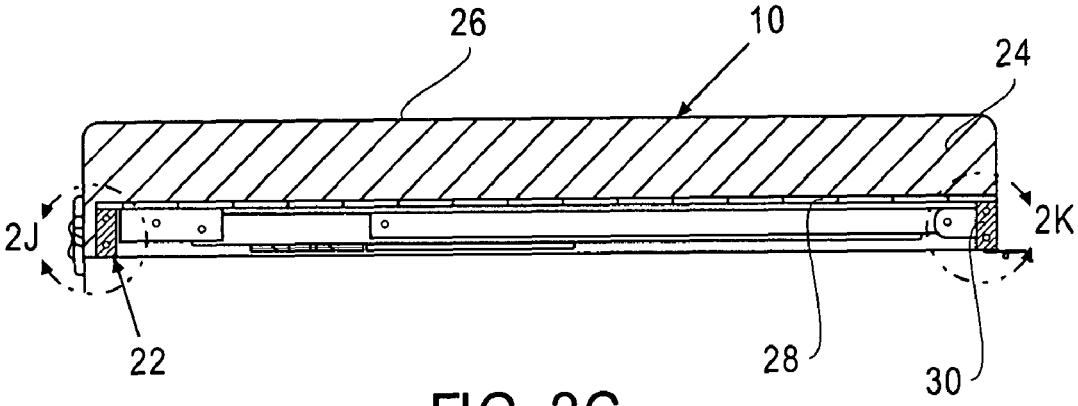
FIG. 2C is a cross-sectional view taken on line 2C-2C in FIG. 2A.

FIG. 2C is a cross-sectional view taken on line 2C-2C in FIG. 2A. Referring to FIGS. 2A-2C, the table top 18B can include (i) a frame 22, (ii) a cushion pad 24 that is positioned on the frame 22, and (iii) a covering 26 that is wrapped around the cushion pad 24 and that is secured to the frame 22. The design of each of these components can be varied to achieve the desired strength and comfort characteristics of the massage table. As provided herein, in certain embodiments, the frame 22 can be made with curved corners to provide improved strength, ease of manufacturing, and flexibility in manufacturing.

The cushion pad 24 provides a cushion for the comfort of the person resting on the massage table 10. Non-exclusive examples of suitable materials for the cushion pad 24 include urethane foam, foam rubber, and memory foam. In non-exclusive embodiments, the cushion pad 346 has a thickness of approximately 1 inch, 1.5 inches, 2 inches, 2.5 inches, 3 inches, or 4 inches.

The covering 26 secures the cushion pad 24 to the frame 22 and provides a protective covering for the cushion pad 24. Non-exclusive examples of suitable materials for the covering 26 include leather, plastic, cloth, sheet vinyl and urethane artificial leather.

The design of the frame 22 can vary pursuant to the teachings provided herein. In FIGS. 2A and 2C, the frame 22 includes a frame base 28 and a curved peripheral border flange 30 that is secured to and cantilevers downward from the perimeter of the frame base 28. The frame base 28 and/or the border flange 30 can be made of a rigid material such plywood, aluminum, Kevlar, nylon, plastic or other suitable materials.

Frame base 28 supports the cushion pad 24 and the person that is resting on the massage table 10. Typically, the cushion pad 24 is positioned on top of the frame base 28. The border flange 30 provides support for the frame base 28 and provides a place to attach the legs 20, the angled braces 16A, and/or the hinge assembly 18C.

In one embodiment, the frame 22 includes a pair of spaced apart leg attachment blocks 31A that secured to the frame base 28 and the border flange 30. In this embodiment, the leg attachment blocks 31A are used to pivotable secure the legs 20 to the frame 22. Additionally, the frame 22 can include a pair of brace flanges 31B that are secured to the frame base 28 and the border flange 30. In this embodiment, the brace flanges 31B are used to pivotable secure the angled braces 16A to the frame base 28 and the border flange 30.

Figure 2D:
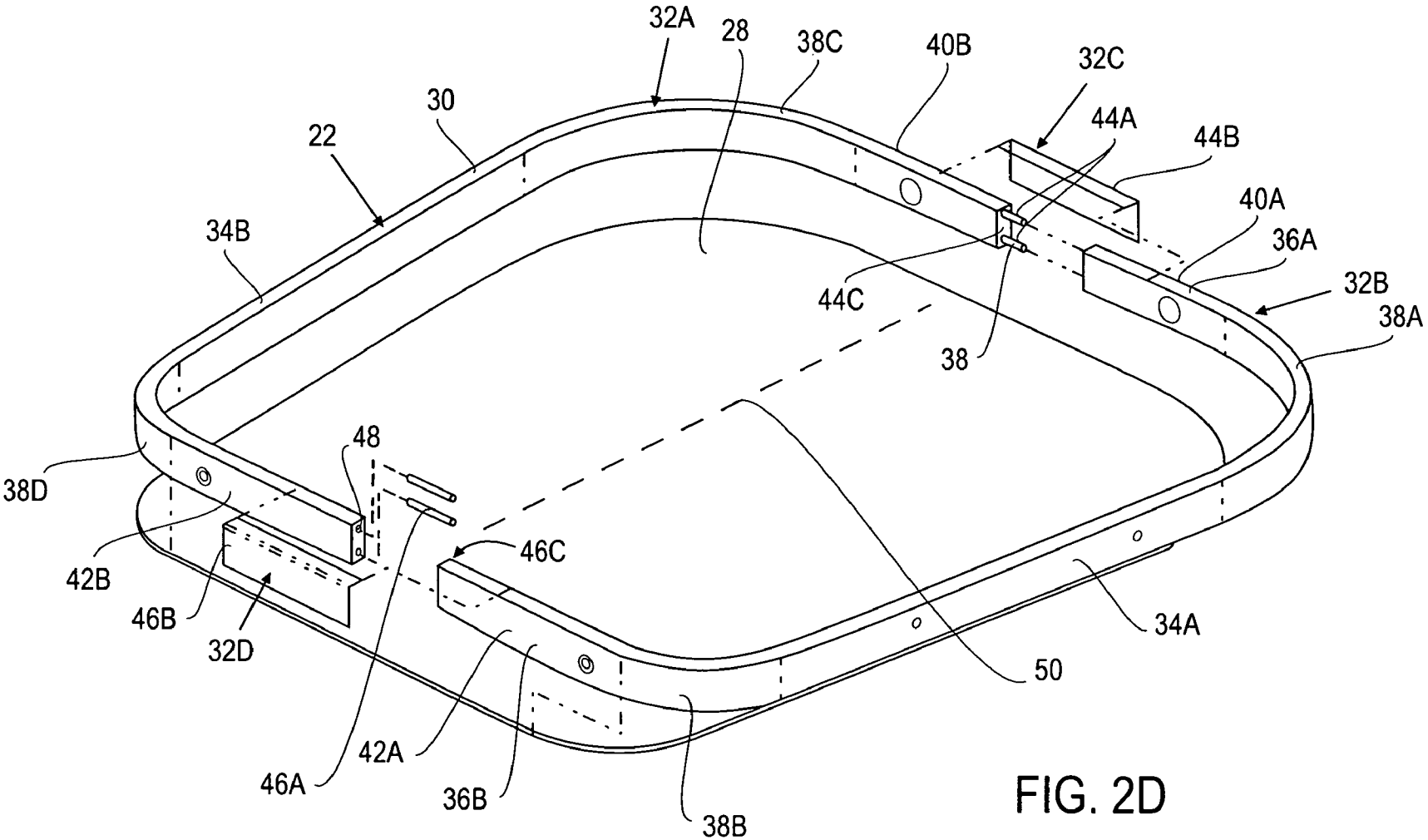
FIG. 2D is an exploded isometric view of a frame from FIG. 2A.

FIG. 2D is an exploded perspective view of a portion of the frame 22 including the frame base 28 and the border flange 30. In this embodiment, the frame base 28 is a generally flat plate shaped and includes four rounded corners. In this embodiment, the frame base 28 has a shape that corresponds to the shape of the border flange 30. More specifically, in FIG.

2D, the frame base 28 is somewhat trapezoidal shaped with rounded corners. Alternatively, for example, the frame base 28 can be another shape, such as generally oval or rectangular shaped with rounded corners.

In alternative, non-exclusive embodiments, the frame base 28 has a thickness of approximately 0.2, 0.3, 0.4, 0.5, 0.6, 0.7, 0.8, or 1 inches. However, other thicknesses can be utilized.

FIGS. 2E-21 are alternative views of one embodiment of the frame 22 including the frame base 28 and the border flange 30. Referring to FIGS. 2D-2I, as an overview, the border flange 30 can be made of one or more flange components, with each flange component being formed of a continuous, jointless piece of material. More specifically, in this embodiment, the border flange 30 includes (i) a first flange component 32A, (ii) a second flange component 32B, (iii) a first attacher 32C that secures a first end of the first flange component 32A to a first end of the second flange component 32B, and (iv) a second attacher 32D that secures a second end of the first flange component 32A to a second end of the second flange component 32B. Alternatively, in certain embodiments, the border flange 30 can be designed to include more than or fewer than two flange components, and/or more than or fewer than two attachers.

The size and shape of the border flange 30 can vary pursuant to the teachings provided herein. In one embodiment, the border flange 30 is somewhat trapezoidal hoop shaped with rounded corners. Alternatively, for example, the border flange 30 can be another shape, such as generally oval or rectangular hoop shaped with rounded corners.

Figure 2E:
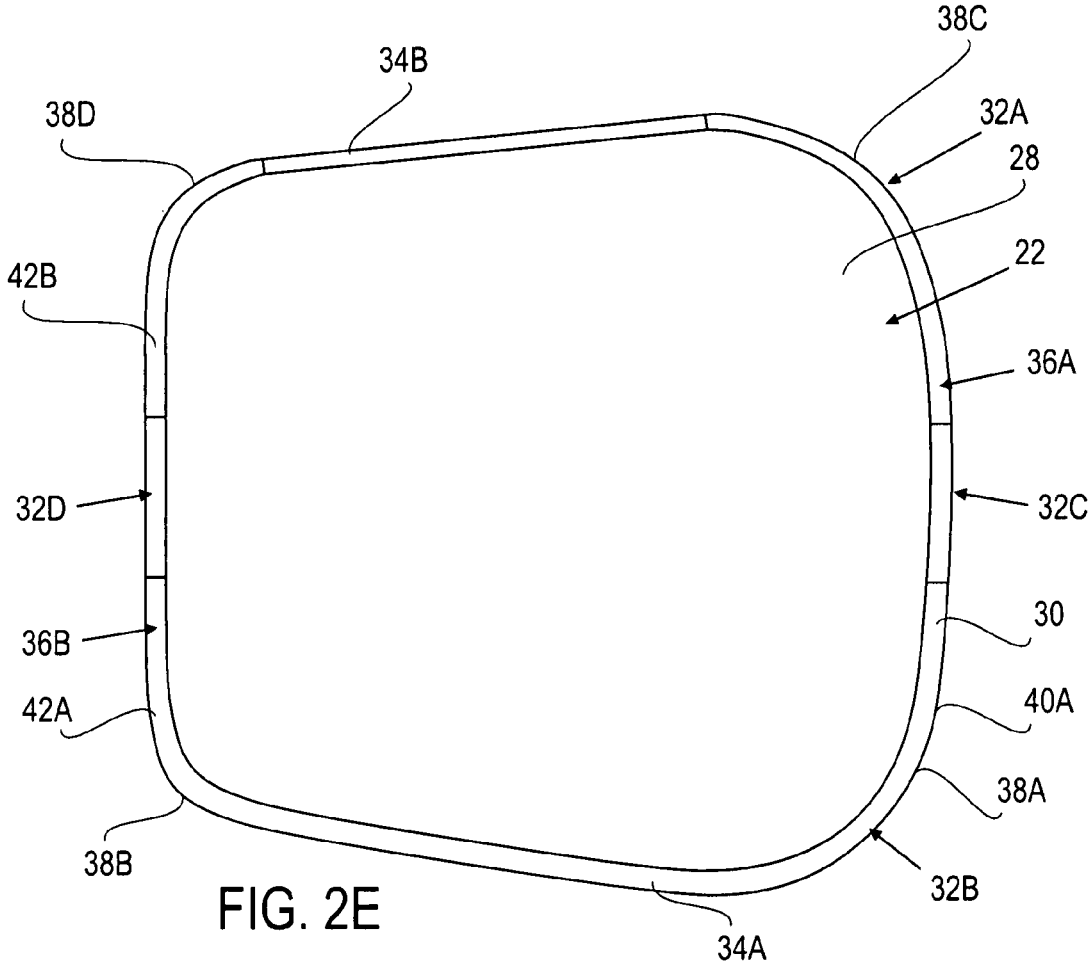
FIGS. 2E-2I are bottom and side views of the frame of FIG. 2D.
Figure 2F:
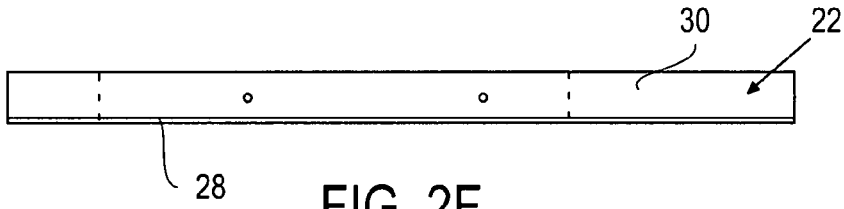
Figure 2G:
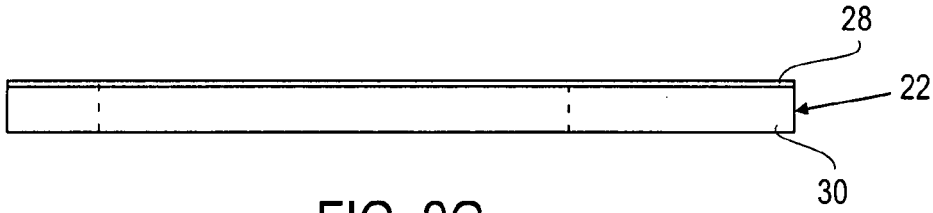
Figure 2H:
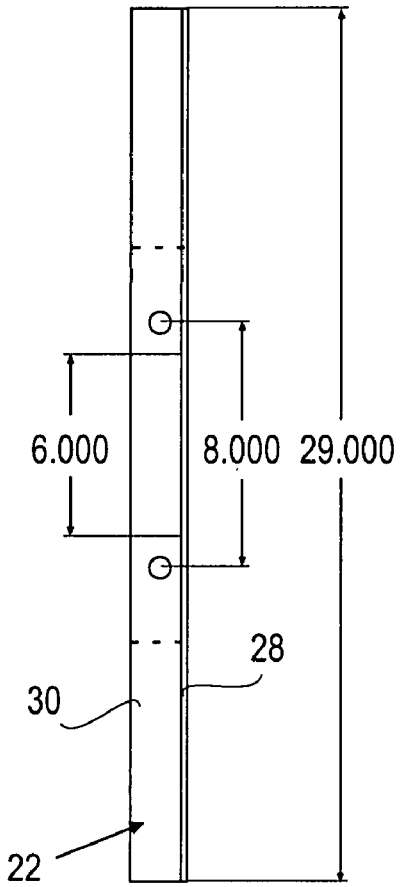
Figure 2I:
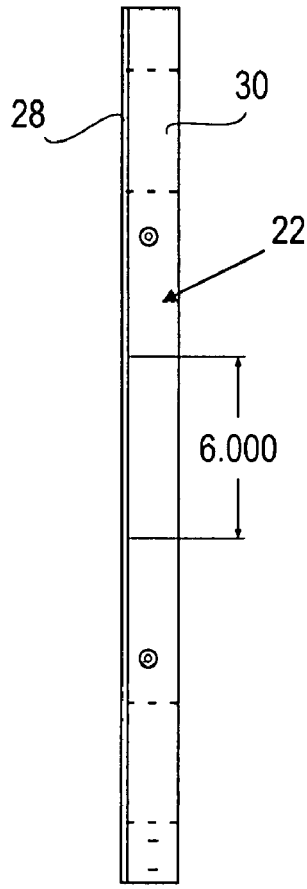

In FIGS. 2D and 2E, the border flange 30 includes (i) a first side section 34A, (ii) a second side section 34B, (iii) a first transverse section 36A, (iv) a second transverse section 36B, (v) a first connector section 38A, (vi) a second connector section 38B, (vii) a third connector section 38C, and (viii) a fourth connector section 38D that cooperate form the border flange 30. It should be noted that the terms first, second, third and fourth are for convenience and that any of these components can be referred to as the first, second, third and fourth.

In this embodiment, the side sections 34A, 34B are generally straight, spaced apart, angled relative to each other, and form the sides of the border flange 30. Further, the transverse sections 36A, 36B are generally straight, spaced apart, generally parallel to each other, and form the outer edge and center edge of the border flange 30. Moreover, the transverse sections 36A, 36B extend generally transversely to the side sections 34A, 34B.

The connector sections 38A-38D connect the side sections 34A, 34B to the transverse sections 36A, 36B. The connector sections 38A-38D can also be referred to as corners. As labeled in the Figures, (i) the first connector section 38A connects the first side section 34A to the first transverse section 36A, (ii) the second connector section 38B connects the first side section 34A to the second transverse section 36B, (iii) the third connector section 38C connects the second side section 34B to the first transverse section 36A, and (iv) the fourth connector section 38D connects the second side section 34B to the second transverse section 36B.

In one embodiment, one or more of the connector sections 38A-38D is curved. For example, in the embodiment illustrated in the Figures, each of the connector sections 38A-38D is curved. For example, in alternative, non-exclusive embodiments, one or more of the connector sections 38A-38D can have a radius of between approximately five and sixteen inches; eight and sixteen inches; or ten and sixteen inches. Alternatively, for example, one or more of the connector sections 38A-38D may not be curved.

The size and shape of each of the sections 34A-38D can vary pursuant to the teachings provided herein. In alternative non-exclusive embodiments, each of the sections 34A-38D has a generally rectangular shaped cross-section with a width of approximately 0.2, 0.3, 0.4, 0.5, 0.6, or 1 inch and a height of approximately 1, 1.2, 1.4, 1.6, 1.8, or 2 inches. Alternatively, the sections 34A-38D could have another configuration.

In one embodiment, (i) a first segment 40A of the first transverse section 36A, a first part 42A of the second transverse section 36B, the entire first side section 34A, the first connector section 38A, and the second connector section 38B cooperated to form the first flange component 32A; and (ii) a second segment 40B of the first transverse section 36A, a second part 42B of the second transverse section 36B, the entire second side section 34B, the third connector section 38C, and the fourth connector section 40D cooperated to form the second flange component 32B. Further, in this embodiment, one or both of the flange components 32A, 32B can be made of a single, continuous, jointless piece of material. In the embodiment illustrated in the Figures, both of the flange components 32A, 32B can be made of a continuous, jointless piece of material.

Moreover, for each flange components 32A, 32B, the continuous, homogenous, jointless, piece of material can be a single continuous piece of curved or bent plywood that is bent during formation to form the respective flange component 32A, 32B. For example, the first segment 40A, the first part 42A, the entire first side section 34A, the first connector section 38A, and the second connector section 38B can be formed from a piece of plywood that is formed into that shape during the manufacturing of the plywood. Further, the second segment 40B, the second part 42B, the entire second side section 34B, the third connector section 38C, and the fourth connector section 38D can be formed from a piece of plywood that is formed into that shape during the manufacturing of the plywood. Because the flange components 32A, 32B are made of continuous pieces of material, joints at the corner of the border flange 30 are eliminated and the border flange 30 has improved strength characteristics.

In one embodiment, the second flange component 32B is a mirror image of the first flange component 32A. In this embodiment, the flange components 32A, 32B can also be referred to as flange halves because each of the flange components 32A, 32B forms half of the border flange.

The first attacher 32C attaches the first segment 40A of the first transverse section 36A to the second segment 40B of the first transverse section 36A. Somewhat similarly, the second attacher 32D attaches the first part 42A of the second transverse section 36B to the second part 42B of the second transverse section 36B.

For example, the first attacher 32C can include one or more first pins 44A that extend between the segments 40A, 40B of the first transverse section 36A and a first brace 44B that extends over a segment junction 44C between the segments 40A, 40B. Similarly, for example, the second attacher 32D can include one or more second pins 46A that extend between the parts 42A, 42B of the second transverse section 36B and a second brace 46B that extends over a part junction 46C between the parts 42A, 42B.

The pins 44A, 46B and the braces 44B, 46B support the respective junction 44C, 46C. In the Figures, each of the pins 44A, 46A is a dowel type pin and each of the braces 44B, 46B is a rigid bracket that has an "L" shaped cross-section and can be made of sheet metal or other type of rigid material. Alternatively, each of the braces 44B, 46B can have another shape or configuration. Each of the pins 44A, 46A can extend and be press fit into apertures 48 in the respective transverse section 36A, 36B. Additionally, a wood type glue or other adhesive can be applied to the pins 44A, 46A prior to insertion into the apertures 48. Each of the braces 44B, 46B can be attached to the respective transverse section 36A, 36B with staples, screws, an adhesive, e.g. an acrylic adhesive, and/or another type of fastener.

The assembled border flange 30 can be secured to the frame base 28 using an adhesive, screws or other types of fasteners.

In one embodiment, the segment junction 44C of the segments 40A, 40B of the first transverse section 36A and the part junction 46C of the parts 42A, 42B of the second transverse section 36B are located near or at a center axis 50 of the massage table 10 and the border flange 30. In this embodiment, the first flange component 32A and the second flange component 32B are joined together at the center axis 50.

With this design, the junctions 44C, 46C of the border flange 30 are located away from any high stress areas of the massage table 10, such as where the legs 20 are attached to the frame 22 or the side sections 34A, 34B of the border flange 30. Stated in another fashion, the joints of the border flange 30 are located away from where the legs 20 are attached to the frame 22 and away from the side sections 34A, 34B of the border flange 30.

Typically, with massage tables 10, the side sections 34A, 34B experience significant amounts of stress. Because, in certain designs there are no joints in the border flange 30 in the side sections 34A, 34B, the massage table 10 is stronger and the joints are located away from areas of high stress.

Moreover, because the joints are located along the central axis 50, the width of the massage table 10 can be easily changed by just trimming the segments 40A, 40B and the parts 42A, 42B. With this design, the same flange components 32A, 32B can be made for massage tables having different widths. This simplifies the manufacturing process used to make table of different widths.

It should also be noted that in certain designs, the hinge assembly 18C is located at the part junction 46C between the flange components 32A, 32B; and the nameplate 18E for the massage table 10 is located at the segment junction 44C between the flange components 32A, 32B. With this design, the hinge assembly 18C can further support the part junction 46C and the nameplate 18E can further support the segment junction 44C.

Figure 2J:
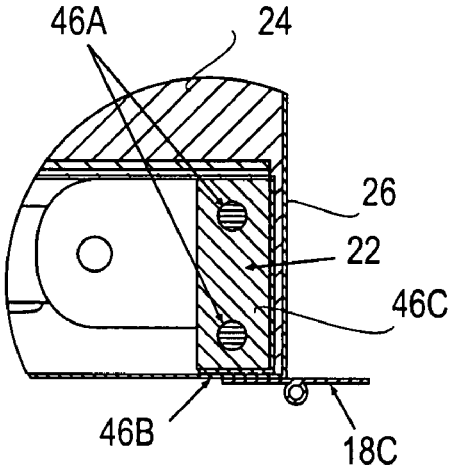
FIG. 2J is an enlarged detail taken from FIG. 2C.

FIG. 2J is an enlarged cut-away view that illustrates the part junction 46C, the second pins 46A, and the second brace 46B in more detail. This Figure also illustrates how the hinge assembly 18C is positioned near and extends across the part junction 46C.

Figure 2K:
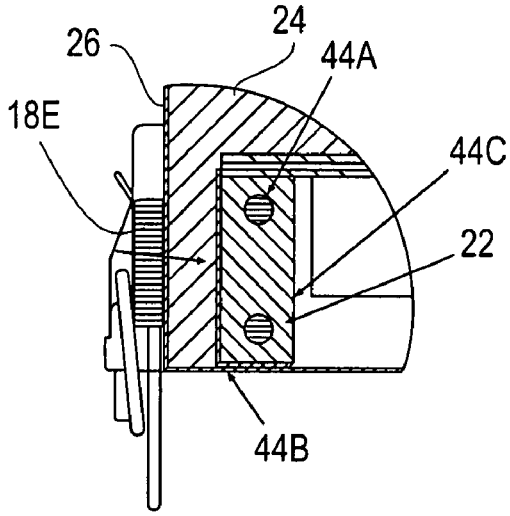
FIG. 2K is an enlarged detail taken form FIG. 2C.

FIG. 2K is an enlarged cut-away view that illustrates the segment junction 44C, the first pins 44A, and the first brace 44B in more detail. This Figure also illustrates how the nameplate 18E is positioned near and extends across the segment junction 44C.

FIGS. 3A-3E illustrate another embodiment of the frame 322 that includes a base frame 328 and a border flange 330 that are somewhat similar to the corresponding components described above. For example, in this embodiment, the border flange 330 again includes two flange components 332A, 332B that are joined together near the central axis 50, and two attachers 332C, 332D. However, in this embodiment, the base frame 328 is generally rectangular shaped with rounded corners, and the border flange 330 is generally rectangular tube shaped with rounded corners.

Figure 3A:
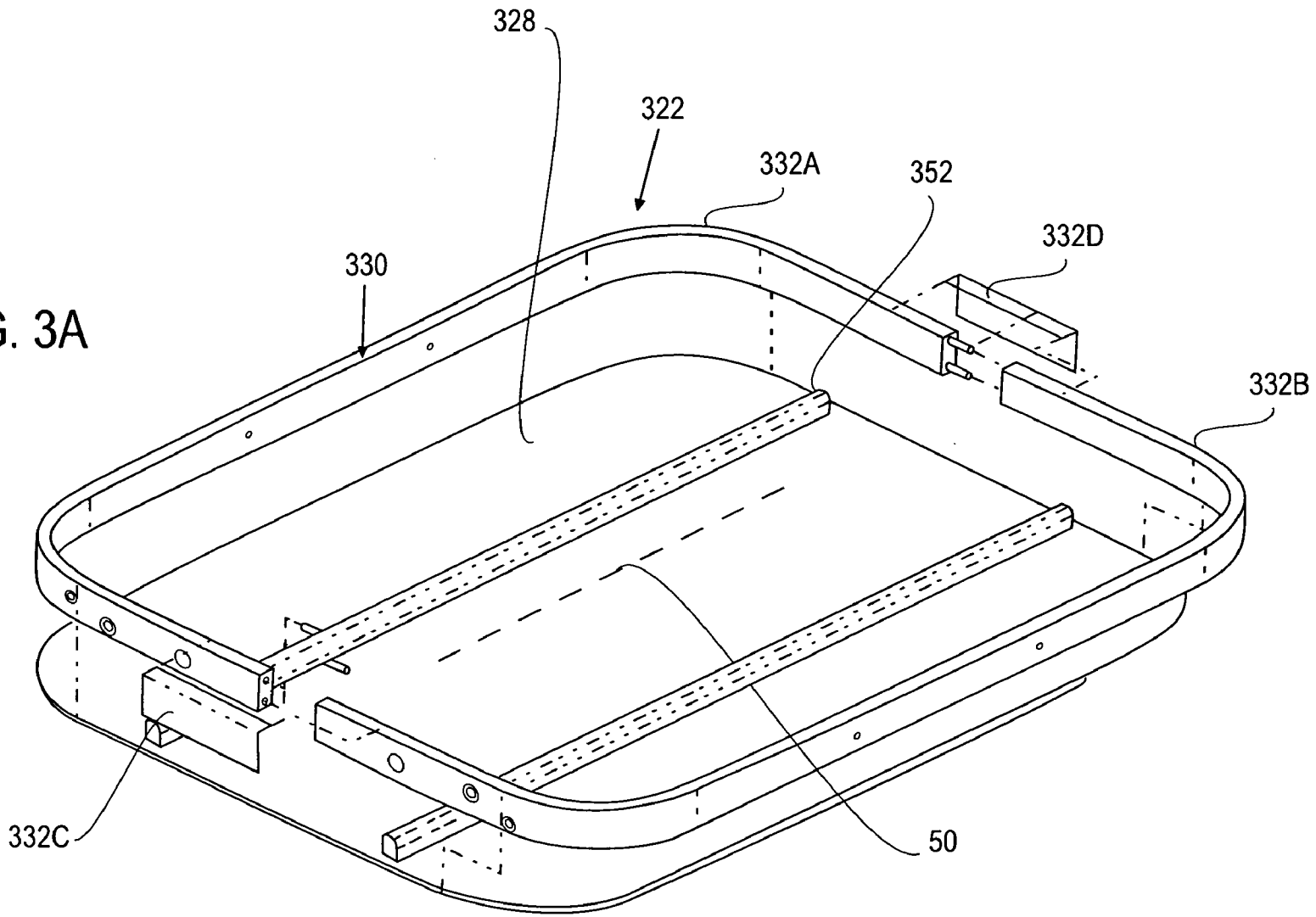
FIG. 3A is an exploded isometric view of another embodiment of a frame having features of the present invention.
Figure 3B:
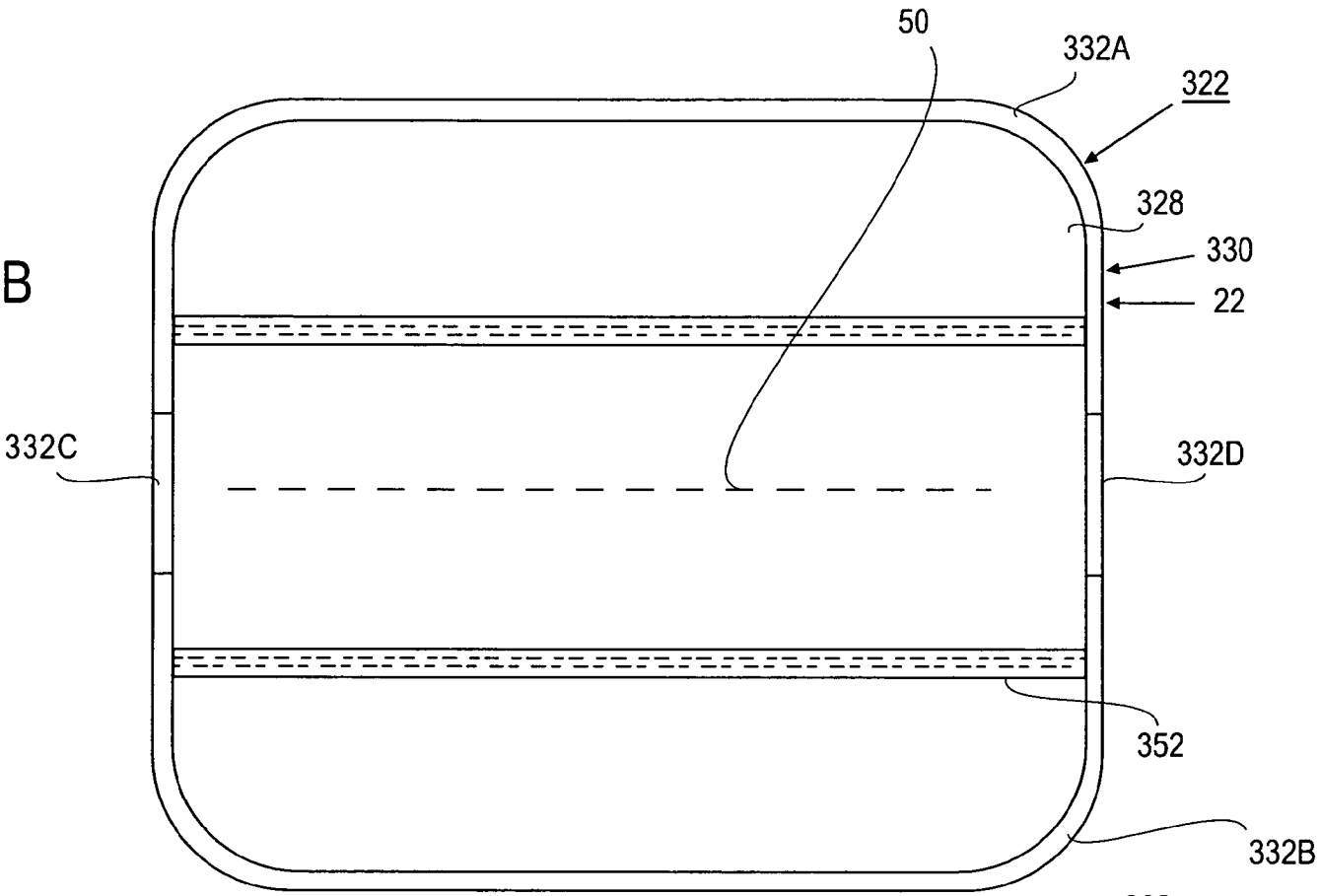
FIGS. 3B-3E are bottom and side views of the frame of FIG. 3A.
Figure 3C:
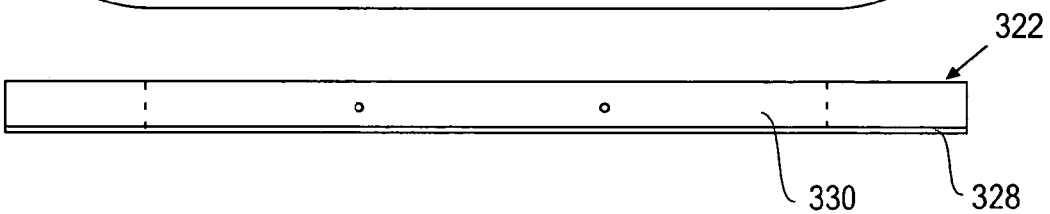
Figure 3D:
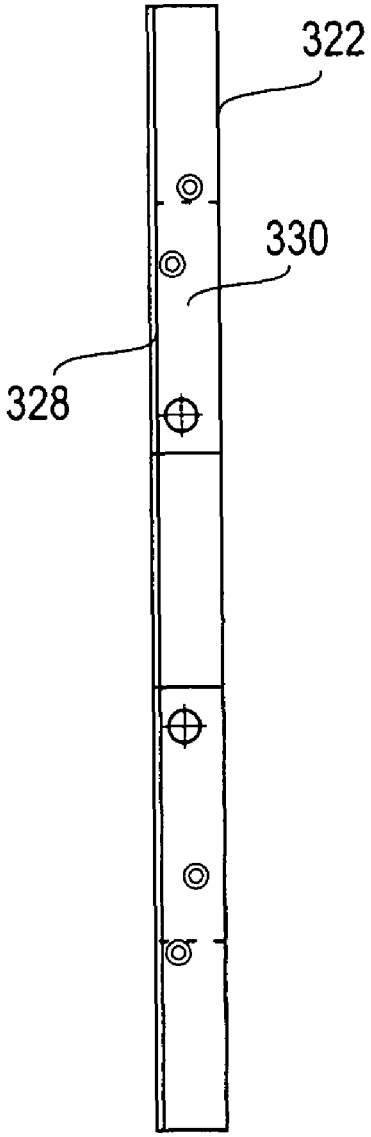
Figure 3E:
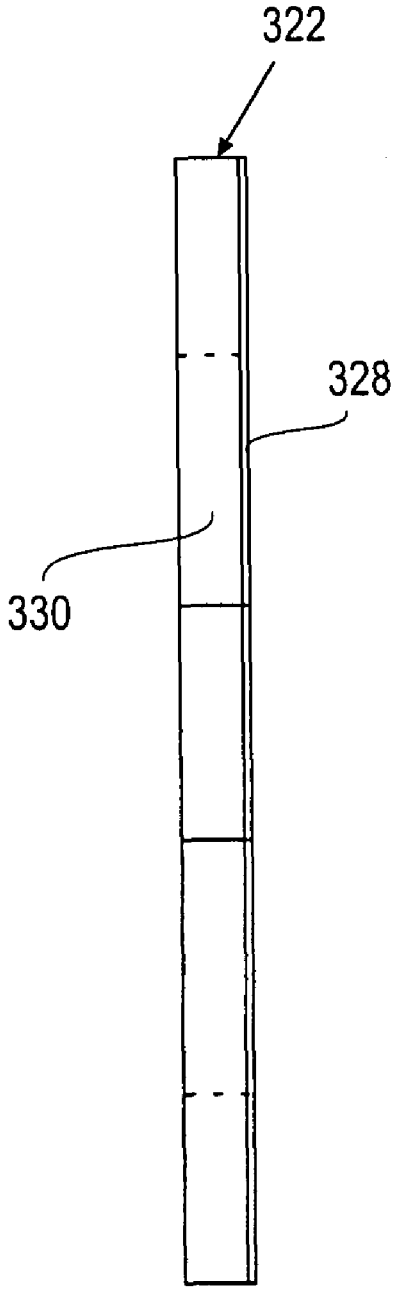

Further, in the embodiment illustrated in FIGS. 3A and 3B, the frame 322 also includes one or more runner supports 352 (two are illustrated) that extend across the border flange 330. The runner supports 352 provide additional strength to the frame 322 and are aligned to transfer the load to the border flange 330. The runner supports 352 can be made of a rigid material such wood, aluminum, plastic or other suitable materials.

While the current invention is disclosed herein, it is to be understood that it is merely illustrative of the presently preferred embodiments of the invention and that no limitations are intended to the details of construction or design herein shown.

What is claimed is:

1. A massage table for supporting a person during a massage above a surface, the massage table comprising:

a leg assembly that engages the floor; and a first table top including a frame that is supported above the surface with the leg assembly, the frame including a frame base that supports at least a portion of the person and a border flange that is secured to the frame base and that extends downward from the frame base, the border flange including a first side section, a first transverse section that extends transversely to the first side section, and a first connector section that connects the first side section to the first transverse section, wherein the first connector section is curved; wherein the border flange includes a second transverse section that extends substantially parallel to the first transverse section and a second connector section that connects the first side section to the second transverse section, wherein the second connector section is curved; wherein the first segment of the first transverse section, a first part of the second transverse section, the entire first side section, the first connector section, and the second connector section are made of a continuous piece of plywood that is bent to form the first connector section and the second connector section.

2. The massage table of claim 1 wherein the border flange includes a second side section that is spaced apart from the first side section, a third connector section that connects the second side section to the first transverse section, and a fourth connector section that connects the second side section to the second transverse section wherein the third connector section is curved and the fourth connector section is curved.

3. The massage table of claim 2 wherein a second segment of the first transverse section, a second part of the second transverse section, the entire second side section, the third connector section, and the fourth connector section are made of a continuous piece of material.

4. The massage table of claim 3 wherein the border flange includes a first attacher that attaches the first segment of the first transverse section to the second segment of the first transverse section, and a second attacher that attaches the first part of the second transverse section to the second part of the second transverse section.

5. The massage table of claim 4 wherein the first attacher includes a pin that extends between the segments of the first transverse section and a brace that extends over a segment junction between the segments.

6. The massage table of claim 4 wherein a segment junction of the segments of the first transverse section and a part junction of the parts of the second transverse section is located near a center axis of the massage table.

7. The massage table of claim 1 wherein the first connector section has a radius of between approximately eight and sixteen inches.

8. A massage table for supporting a person during a massage above a surface, the massage table comprising:

a leg assembly that engages the floor; and a first table top including a frame that is supported above the surface with the leg assembly, the frame including a frame base that supports at least a portion of the person and a border flange that is secured to the frame base and that extends downward from the frame base, the border flange including a first side section, a first transverse section that extends transversely to the first side section, and a first connector section that connects the first side section to the first transverse section, wherein a first segment of the first transverse section, the first side section, and the first connector section are made of a continuous piece of plywood that is bent to form the first connector section.

9. The massage table of claim 8 wherein the border flange includes a second transverse section that extends substantially parallel to the first transverse section and a curved second connector section that connects the first side section to the second transverse section.

10. The massage table of claim 9 wherein the first segment of the first transverse section, a first part of the second transverse section, the entire first side section, the first connector section, and the second connector section are made of a continuous piece of plywood.

11. The massage table of claim 10 wherein the border flange includes a second side section that is spaced apart from the first side section, a third connector section that connects the second side section to the first transverse section, and a fourth connector section that connects the second side section to the second transverse section wherein the third connector section is curved and the fourth connector section is curved.

12. The massage table of claim 11 wherein a second segment of the first transverse section, a second part of the second transverse section, the entire second side section, the third connector section, and the fourth connector section are made of a continuous piece of plywood.

13. The massage table of claim 12 wherein the border flange includes a first attacher that attaches the first segment of the first transverse section to the second segment of the first transverse section, and a second attacher that attaches the first part of the second transverse section to the second part of the second transverse section.

14. The massage table of claim 13 wherein the first attacher includes a pin that extends between the segments of the first transverse section and a brace that extends over a segment junction between the segments.

15. The massage table of claim 13 wherein a segment junction of the segments of the first transverse section and a part junction of the parts of the second transverse section is located near a center axis of the massage table.

16. A massage table for supporting a person during a massage above a surface, the massage table comprising:

a leg assembly that engages the floor; and a first table top including a frame that is supported above the surface with the leg assembly, the frame including a frame base that supports at least a portion of the person and a border flange that is secured to the frame base and that extends downward from the frame base, the border flange including (i) a first side section, (ii) a first transverse section that extends transversely to the first side section, (iii) a curved first connector section that connects the first side section to the first transverse section, (iv) a second transverse section that extends substantially parallel to the first transverse section, (v) a curved second connector section that connects the first side section to the second transverse section, (vi) a second side section that is spaced apart from the first side section, (vii) a curved third connector section that connects the second side section to the first transverse section, and (viii) a curved fourth connector section that connects the second side section to the second transverse section;

wherein a first segment of the first transverse section, the first connector section, the first side section, the second connector section, and a first part of the second transverse section are made of a continuous piece of plywood that is bent into a somewhat C shaped configuration;

wherein a second segment of the first transverse section, the third connector section, the second side section, the fourth connector section, and a second part of the second transverse section are made of a continuous piece of plywood that is bent into a somewhat C shaped configuration; and wherein the leg assembly includes a first leg that is secured to the frame near the first connector section and a second leg that is secured to the frame near the third connector section;

wherein the border flange includes a first attacher that attaches the first segment of the first transverse section to the second segment of the first transverse section, and a second attacher that attaches the first part of the second transverse section to the second part of the second transverse section.

17. The massage table of claim 16 wherein a segment junction of the segments of the first transverse section and a part junction of the parts of the second transverse section is located near a center axis of the massage table.

18. A massage table for supporting a person during a massage above a surface, the massage table comprising:

a leg assembly that engages the floor; and a first table top including a frame that is supported above the surface with the leg assembly, the frame including a frame base that supports at least a portion of the person and a border flange that is secured to the frame base and that extends downward from the frame base, the border flange including (i) a rigid, first section that is made of a continuous piece of bend plywood; and (ii) a rigid second section that is attached to the first section at two spaced apart locations; wherein the first section and the second section attached together have a somewhat rounded rectangular shape with two generally straight side sections that are spaced apart by two generally straight transverse sections.

19. The massage table of claim 18 wherein the first section is somewhat C shaped, and wherein the border flange includes a first attacher that attaches the first section to the second section, and a second attacher that attaches the first section to the second section.

* * * * *

UNITED STATES PATENT AND TRADEMARK OFFICE

CERTIFICATE OF CORRECTION

PATENT NO. : 7,823,517 B2
APPLICATION NO. : 11/804670
DATED : November 2, 2010
INVENTOR(S) : Jon W. Roleder It is certified that error appears in the above-identified patent and that said Letters Patent is hereby corrected as shown below:

Title Page item 56

References Cited:

Other Publications

Title Page 2, Column 2, after "Oakworks, Inc., 2005." please insert

-- Earthlite Massage Tables, Inc. product brochure. This brochure includes pictures of prior art massage tables sold by Earthlite Massage Tables, Inc. --.

Signed and Sealed this
Twenty-eighth Day of December, 2010

David J. Kappos

David J. Kappos
*Director of the United States Patent and Trademark Office*